US008360415B1

(12) United States Patent
Herrmann et al.

(10) Patent No.: US 8,360,415 B1
(45) Date of Patent: Jan. 29, 2013

(54) AUTOMATIC FEED ROLL CLEANING SYSTEM

(75) Inventors: Douglas K. Herrmann, Webster, NY (US); Adam D. Ledgerwood, Geneva, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/401,039

(22) Filed: Feb. 21, 2012

(51) Int. Cl.
*B65H 3/06* (2006.01)
*B65H 1/00* (2006.01)

(52) U.S. Cl. ..... 271/109; 271/145; 271/147

(58) Field of Classification Search ..... 271/145, 271/147, 109
See application file for complete search history.

(56) References Cited

U.S. PATENT DOCUMENTS

| | | | | |
|---|---|---|---|---|
| 4,843,436 | A | 6/1989 | Evangelista et al. | |
| 6,155,557 | A * | 12/2000 | Suzuki | 271/119 |
| 6,877,737 | B2 * | 4/2005 | Yanagi et al. | 271/121 |
| 7,523,933 | B2 | 4/2009 | Linder et al. | |
| 7,669,846 | B1 | 3/2010 | Hoover et al. | |
| 7,711,309 | B2 | 5/2010 | Okazaki | |
| 7,778,588 | B2 | 8/2010 | Okazaki | |
| 7,900,919 | B2 | 3/2011 | Ledgerwood et al. | |
| 7,922,169 | B2 | 4/2011 | Mandel | |
| 2007/0290432 | A1 * | 12/2007 | Kojima | 271/147 |

* cited by examiner

*Primary Examiner* — David H Bollinger
(74) *Attorney, Agent, or Firm* — Maginot, Moore & Beck, LLP

(57) ABSTRACT

A media tray includes a cleaning mechanism that is fed into the media feed system of a printer automatically when the media tray is emptied of print media and then retracted when the media tray is accessed.

17 Claims, 6 Drawing Sheets

AUTOMATIC FEED ROLL CLEANING SYSTEM

TECHNICAL FIELD

This disclosure relates generally to devices for managing print media in a printer and, more particularly, to devices for handling stacks of media sheets in a printer.

BACKGROUND

Many imaging devices, such as printers, photocopiers, and multi-function imaging devices, store a supply of media sheets, such as paper sheets, in one or more internal trays. The sheets are vertically stacked within the trays by a user or service technician. Media trays are sized and configured to hold hundreds or thousands of sheets. A media feeding system is used to extract the top sheet from the stack of print media in the tray and deliver the top sheet into a media transport system of the printer.

Media feeding systems often utilize rollers or similar structures to frictionally engage the print media and move the print media in a desired direction. Over time, paper dust, debris, and contaminants can build up on the rollers of the feed system. This dust buildup can degrade the frictional properties of rollers of the media feed system and, as a result, negatively impact performance. As a result, the media feeding systems of imaging devices require periodic cleaning to remove the dust and contamination from the rollers in order to maintain consistent and reliable feed performance.

Some previously known imaging devices require that the media feed system be cleaned manually by an operator of the device. Typically, this manual cleaning requires that the operator be able to identify the need to clean the rollers and have the knowledge to access the feed rollers for cleaning. Other previously known imaging devices have been configured to utilize a cleaning sheet that is fed through the system to clean the rollers. Using a cleaning sheet requires dedicated times when the printing operations are stopped so the cleaning sheet can be fed through the system and can generate faults, which have to be cleared before resuming operations. Some imaging devices have been equipped with dedicated roll cleaners that are added to the feed system. The roll cleaners are continuously in use and can add cost and complexity to the media feed system.

Cleaning rollers in a media feeder of an imaging device without requiring operator intervention or device downtime would be beneficial.

SUMMARY

In accordance with one embodiment, a media feeding apparatus for a printer comprises a first member configured to move print media in a process direction in a printer, and a media tray configured to retain a stack of print media. The media tray includes a first plate movable between a first position where the first plate is spaced a first distance from the first member and a second position where the first plate is spaced a second distance from the first member, the second distance being less than the first distance. The media tray also includes a second plate operatively connected to the first plate. The second plate is selectively displaceable in the process direction with respect to the first plate to move between a first position out of contact with the first member and a second position where the second plate contacts the first member.

In accordance with another embodiment, a method of operating a media feeding apparatus for a printer comprises elevating a first plate of a media tray toward a first member of a media feeder. The first plate is configured to hold a stack of print media. The first member is configured to engage a top sheet of the stack and to move the top sheet in a process direction. A second plate is contacted with the first member when the first plate is empty of print media. The second plate is operatively connected to the first plate and selectively displaceable in the process direction with respect to the first plate. The first member is actuated to drive the second plate in the process direction from a first position out of contact with a second member of the media feeder to a second position where the second plate contacts the second member.

DETAILED DESCRIPTION

Figure 1:
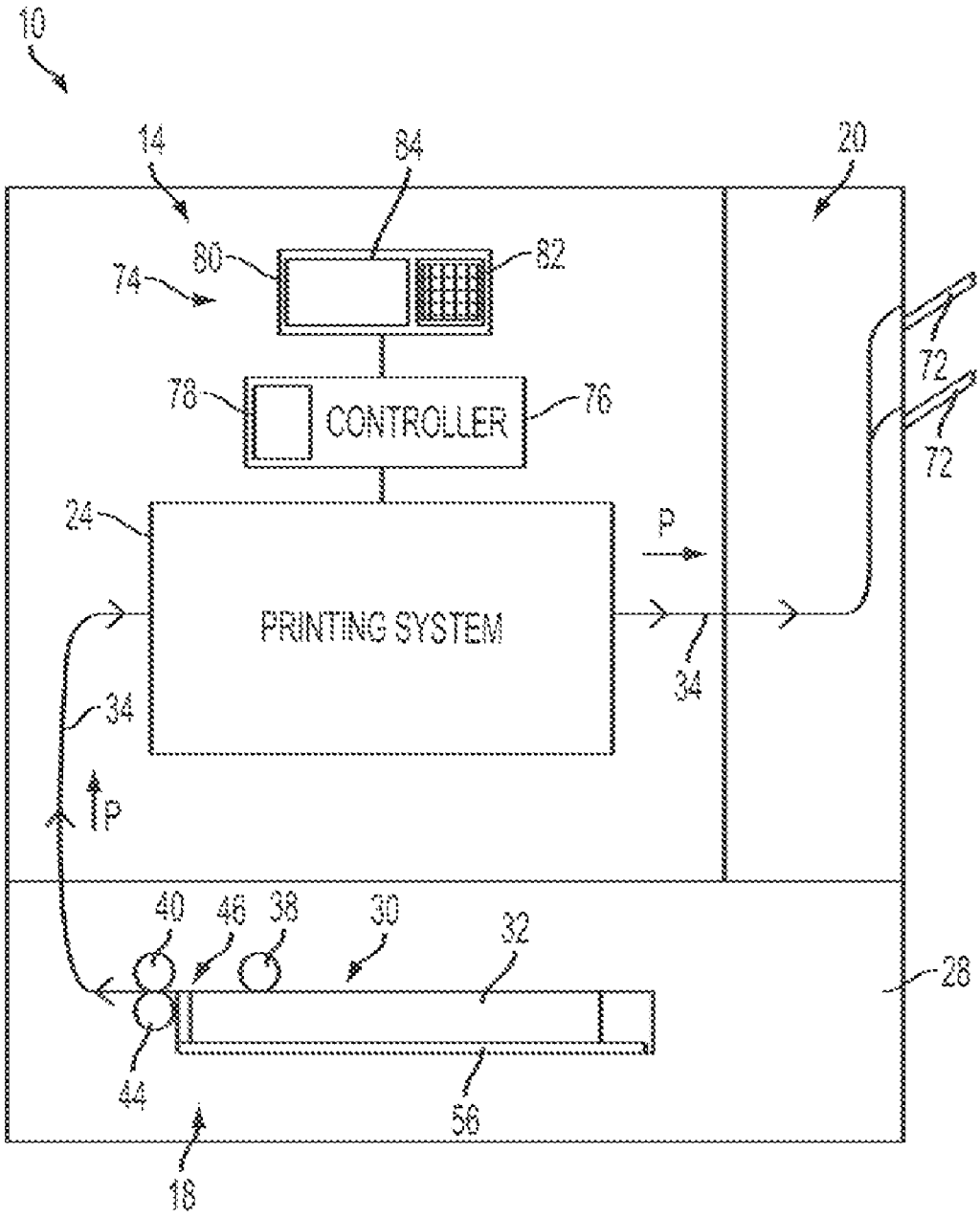
FIG. 1 is a schematic view of an imaging device that includes a media tray equipped with a cleaning mechanism according to the present disclosure.

For a general understanding of the environment for the devices and methods disclosed herein as well as the details for the devices and methods, reference is made to the drawings. In the drawings, like reference numerals designate like elements.

In this document, the term "printer" refers to any device that is configured to form images on print media using a marking agent. "Marking agent" as used in this document refers to colorants that include, but are not limited to, toner, aqueous ink, oil-based ink, solid ink, phase change ink, and UV curable ink. Print media refers to a substrate or sheet of material that receives marking agent, such as various types of paper, parchment, cloth, cardboard, plastic, transparencies, film, foil, or the like. As used herein, the term "media sheet" refers to a single sheet of material that passes through a printer. The printer forms an image on one or both sides of the media sheet in a simplex or duplex print mode, respectively. A stack of media sheets includes a plurality of media sheets arranged vertically on top of one another. As used herein, the process direction is the direction in which a sheet of media is transported through a printer. The reverse direction is the direction opposite the process direction.

Referring to FIG. 1, the present disclosure is directed to a media tray 28 for a printer 10 that has an integrated cleaning mechanism (FIG. 2) for cleaning the media feeder 30 of the printer 10. The media tray 28 is configured to hold a media stack 32 and position the media stack 32 for access by the media feeder 30. The media feeder 30 includes rollers 38, 40, 44 that engage the top sheet of the media stack and deliver the top sheet into the media transport system 34 of the printer. As discussed below, the media tray 28 is equipped with a cleaning mechanism in the form of a cleaning plate 100 (FIG. 2) that is drawn into the media feeder 30 when the media tray 28 is empty of print media. The rollers of the media feeder 30 are rotated against the cleaning plate to clean the rollers of paper dust, debris, and other contaminants that can build up in the media feeder 30 over time. The media tray 28 retracts the cleaning plate 100 from the media feeder 30 when the media tray 28 is accessed.

FIG. 1 is schematic view of a printer equipped with a media tray 28 according to the present disclosure. The printer 10 includes a printing unit 14, a media supply 18, and a media finisher 20. The printer 10 may comprise any device that is capable of forming images on print media including any of a number of different types of printers, copiers, facsimile devices, and multi-function devices (MFDs), for example. Although described in conjunction with a printer, a media tray 28 in accordance with the present disclosure may also be incorporated into media and/or document handling systems of non-printing devices, such as dedicated or specialized document scanners or readers, mail handling machines, check readers, and stand-alone media supply modules.

The printing unit 14 includes a printing system 24 for printing images on print media. The printing system 24 comprises one or more marking engines (not shown) that are configured to deposit marking agent onto print media to form images. Marking engines may be configured to utilize any type or method of printing including, for example, electrophotographic, laser, liquid inkjet, phase change inkjet, solid ink, dye sublimation, direct printing, and offset printing. In addition, marking engines may be configured to utilize any marking agent.

Media supply 18 includes at least one media tray 28 that holds a stack 32 of print media for delivery to the printing unit 14. A single media tray 28 is depicted in the embodiment of the media supply 18 of FIG. 1. The media tray 28 is configured to hold a predetermined number of sheets of a particular type of print media. In other embodiments, a plurality of media trays may be provided for holding different media of different types (e.g., different size, weight, color, coating, transparency, and the like). Media trays may be incorporated into drawers that are capable being withdrawn from the printer to load print media.

The media supply includes a media feeder 30 configured to extract the top sheet from the media stack 32 in the media tray and deliver the top sheet to the media transport system 34 of the printing unit 14. The media feeder of the media supply of FIG. 1 comprises a friction retard feeder. The friction retard feeder includes a plurality of cylindrical rollers, referred to herein as rolls, that are positioned to frictionally engage and separate the top sheet from the media stack 32 and drive the top sheet in the process direction into the media transport system of the printer. In the embodiment of FIG. 1, the plurality of rolls includes a nudger roll 38, a feed roll 40, and a retard roll 44. The rolls 38, 40, 44 are formed of a material, such as rubber, that facilitates frictional engagement with the surface of a sheet of media.

The nudger roll 38 is supported directly above the media stack 32 in the media tray 28 in order to engage the top sheet of the stack 32 and advance the top sheet in the process direction P. The feed roll 40 and retard roll 44 are arranged to form a nip 46, commonly referred to as a feeder nip or separation nip, which is positioned to receive the top sheet from the nudger roll 38. The nudger roll 38 and feed roll 40 are each operatively connected to actuators 48, 50 (FIG. 2), respectively, such as an electrical motor, which drives the rolls 38, 40 to rotate at one or more predetermined rotational speeds. Although a separate actuator 48, 50 is depicted for each of the nudger roll 38 and the feed roll 40 in FIG. 2, the nudger roll 38 and feed roll 40 may be operatively connected to and driven by the same actuator in some embodiments.

The top sheet of the media stack 32 may sometimes drag one or more additional media sheets into the feed nip 46. The retard roll 44 is configured to prevent the additional media sheets from passing through the feed nip 46 with the top sheet. For example, the retard roll 44 may be coupled to a mechanism, such as a slip clutch 54, which allows the retard roll 44 to rotate in the process direction when only the top sheet or no sheet is located in the nip 46. In one embodiment, when more than one sheet is located in the nip, the mechanism allows an actuator 52 (FIG. 2) to rotate the retard roll 44 in the reverse direction. Alternatively, the mechanism 54 may be configured to prevent the retard roll 44 from rotating in the process direction when more than one sheet is located in the nip. In this configuration, the actuator 52 is omitted.

Figure 2:
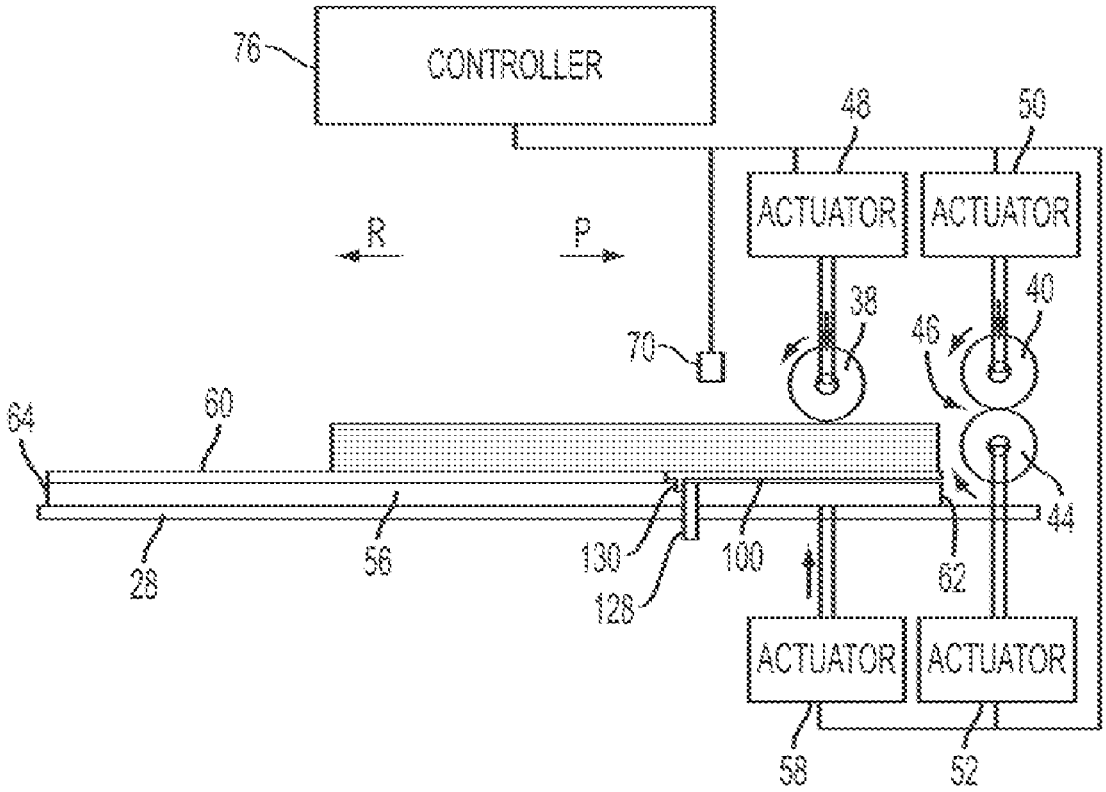
FIG. 2 is a schematic view of the media tray and media feeder of FIG. 1 showing a cleaning plate attached to the media tray.
Figure 4:
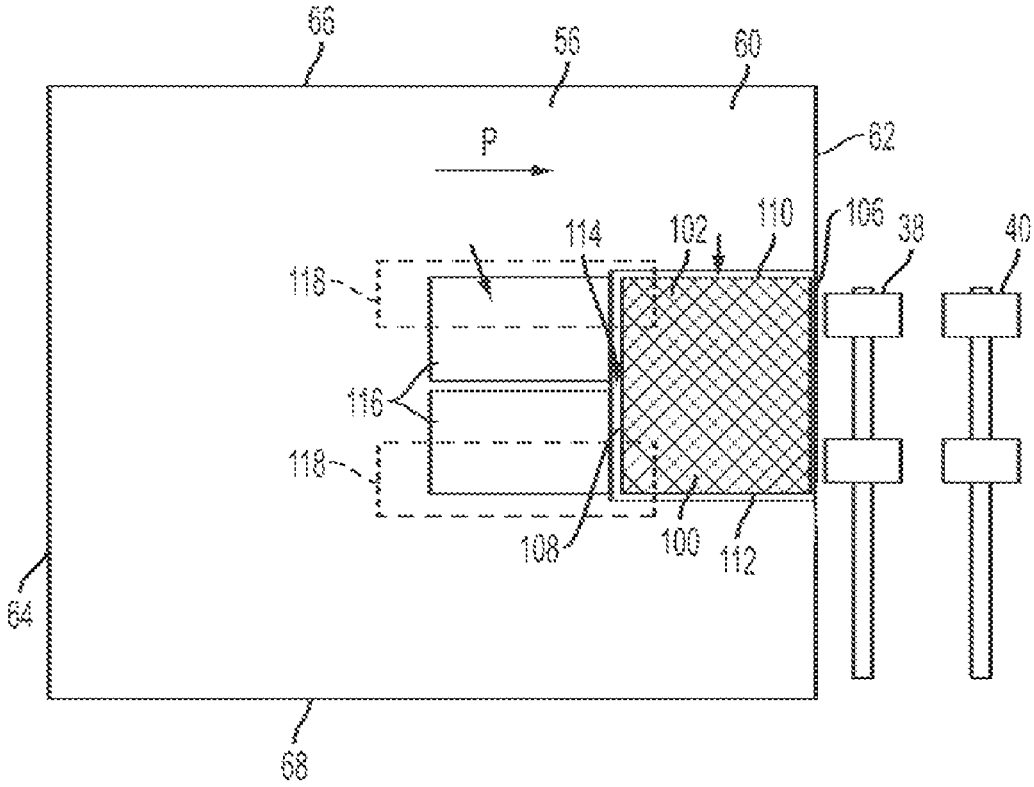
FIG. 4 is a top view of the media tray and media feeder of FIG. 2 with the cleaning plate in a retracted position.

The media tray 28 includes an elevator plate 56 and an elevating mechanism 58 (FIG. 2). The elevator plate 56 of the media tray 28 includes an upper surface 60, a leading edge 62, a trailing edge 64, and a pair of lateral edges 66, 68 (FIG. 4). The upper surface 60 of the elevator plate 56 provides a generally flat, level surface upon which the stack of media is placed. The elevator plate 56 is supported in the media tray 28 with the leading edge 62 oriented in process direction P and the trailing edge 64 oriented in the reverse direction R.

The elevating mechanism 58 comprises an actuator, such as an electrical motor, which is operatively connected to the elevator plate 56. The elevating mechanism 58 is configured to lift the elevator plate 56 generally vertically as sheets are extracted from the stack 32 in order to maintain the top sheet of the stack 32 at an appropriate height for engagement with media feeder 30. The elevating mechanism 58 is controlled based on the output of one or more media sensors 70 associated with the media tray 28. The media sensor(s) 70 generates signals indicative of the height or position of the top of the media stack in the media tray.

The media transport system 34 includes various devices, such as drive rolls, idler rolls, nips, baffles, air jets, and the like, which are arranged to form a network of media pathways. The pathways guide print media in the process direction from the media supply 18 to the printing system 24 where images are formed on the print media and then from the printing system 24 to the media finisher 20. The media finisher 20 receives print media from the transport system 34 and routes the print media to output trays 72. The media finisher 20 may be configured to perform one or more finishing operations to the print media including, for example, stacking, collating, stapling, hole punching, offsetting, binding, and folding.

A control system 74 aids in operation and control of the various subsystems, components, and functions of the printer 10. The control system 74 is operatively connected to one or more image sources (not shown), such as a scanner system or a work station connection, to receive and manage image data from the sources and to generate control signals that are delivered to the components and subsystems of the printer. Some of the control signals are based on the image data and operate the printing system 24 to form images on print media. Other control signals cause the components and subsystems of the printer 10 to perform various procedures and operations such as actuating the media tray 28 and media feeder 30 to deliver print media to the media transport system 34 of the printing unit 14.

The control system 74 includes a controller 76, electronic storage or memory 78, and a user interface (UI) 80. The controller 76 comprises a processing device, such as a central processing unit (CPU), an application specific integrated circuit (ASIC), a field programmable gate array (FPGA) device, or a microcontroller. Among other tasks, the processing device processes images provided by the image sources (not shown). The one or more processing devices comprising the controller 76 are configured with programmed instructions that are stored in the memory 78. The controller 76 executes these instructions to operate the components and subsystems of the printer. Any suitable type of memory or electronic storage can be used. For example, the memory 78 can be a non-volatile memory, such as read only memory (ROM), or a programmable non-volatile memory, such as EEPROM or flash memory.

User interface (UI) 80 comprises a suitable input/output device located on the printer 10 that enables operator interaction with the control system 74. For example, UI 80 can include a keypad 82 and display 84. The controller 76 is operatively coupled to the user interface 80 to receive signals indicative of selections and other information input to the user interface 80 by a user or operator of the device. Controller 76 is operatively coupled to the user interface 80 to display information to a user or operator including selectable options, machine status, consumable status, and the like. The controller 76 can also be coupled to a communication link (not shown), such as a computer network, for receiving image data and user interaction data from remote locations.

Figure 5:
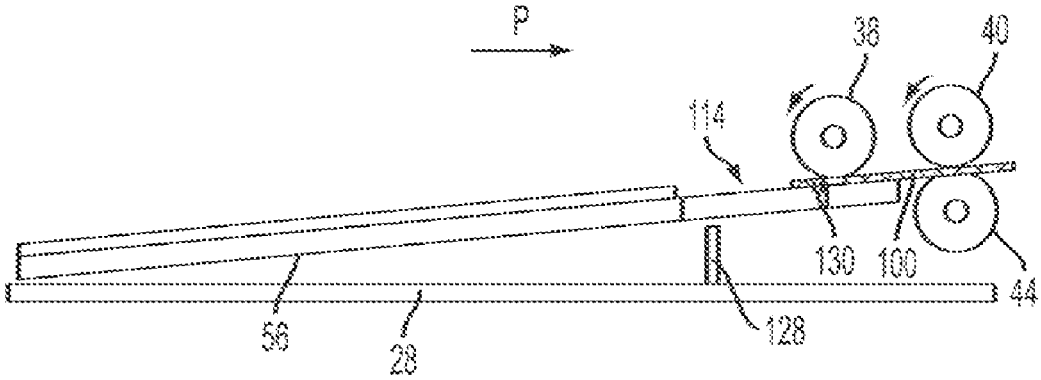
FIG. 5 is a side view of the media tray and media feeder of FIG. 2 with the cleaning plate in an extended position.
Figure 6:
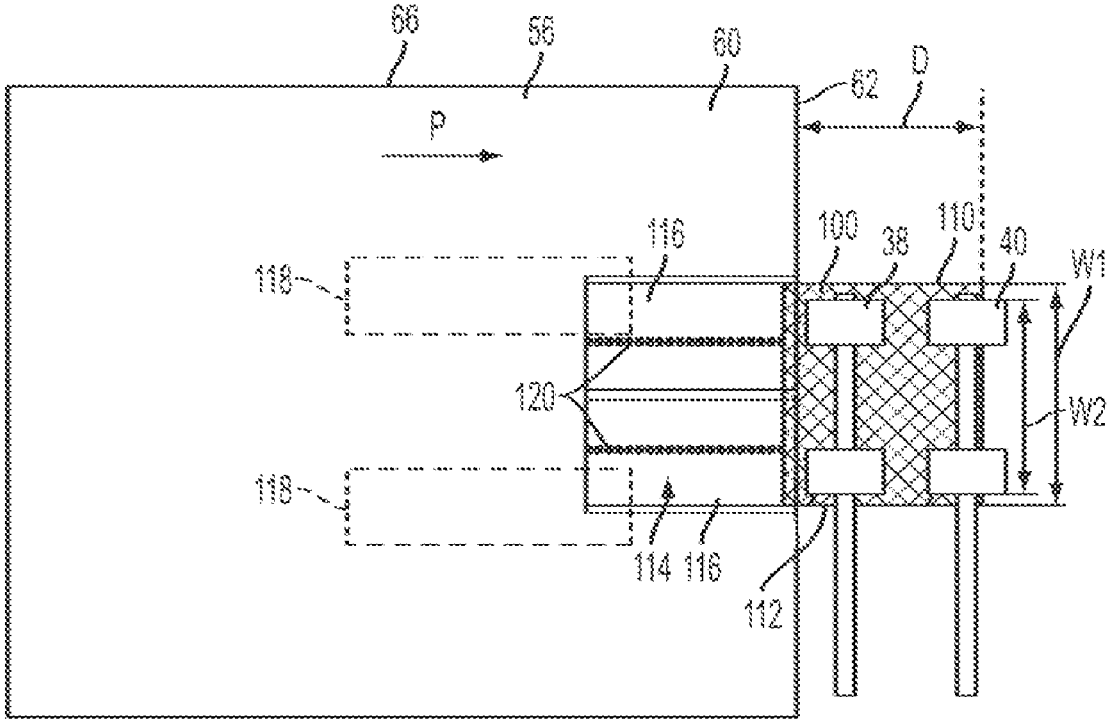
FIG. 6 is a top view of the media tray and media feeder of FIG. 2 with the cleaning plate in an extended position.

Referring to FIGS. 2-6, a cleaning plate 100 is slidably attached to the elevator plate 56 for movement between a retracted position (FIGS. 2-4) and an extended position (FIGS. 5 and 6). The cleaning plate 100 comprises a generally planar member having an upper surface 102, a lower surface 104, a leading edge 106, a trailing edge 108, a first lateral edge 110, and a second lateral edge 112. The cleaning plate 100 is attached to the elevator plate 56 with the leading edge 106 oriented in the process direction P and the trailing edge oriented in the reverse direction R.

Referring to FIG. 6, the cleaning plate 100 is sized such that the width W1 of the cleaning plate between the first and second lateral edges 110, 112 is equal to or greater than the width W2 of the rolls 38, 40, 44 of the media feeder 30. In addition, the cleaning plate 100 has a thickness between the upper and lower surfaces 102, 104 that enables the cleaning plate 100 to be received between the feed roll 40 and retard roll 44 in the feed nip 46. The upper and lower surfaces 102, 104 of the cleaning plate 100 can have a surface texture or treatment that facilitates cleaning of the rolls 38, 40, 44 of the media feeder 30.

Figure 3:
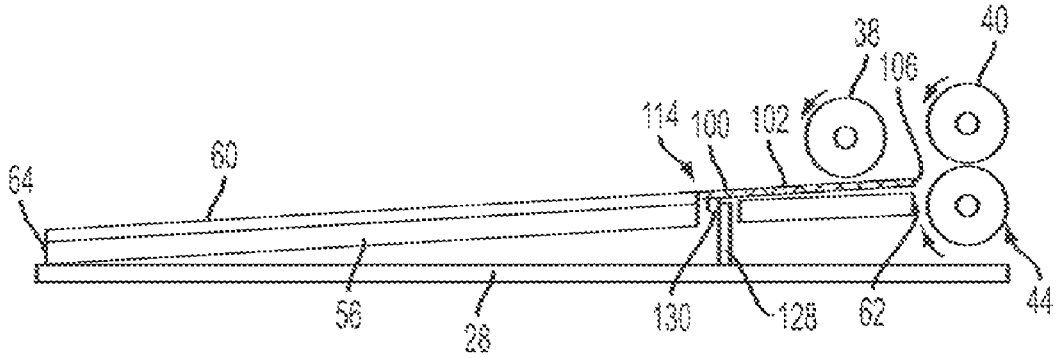
FIG. 3 is a side view of the media tray and media feeder of FIG. 2 with the cleaning plate in a retracted position.

In one embodiment, the cleaning plate 100 is slidably received in a docking region 114 provided in elevator plate 56. The docking region 114 comprises an opening or cutout in the leading edge 62 of the elevator plate 56 that is sized and shaped complementary to the cleaning plate 100. The cleaning plate 100 is seated in the docking region 114 of the elevator plate 56 when the cleaning plate 100 is in the retracted position as depicted in FIGS. 2-4. When seated in the docking region 114 in the retracted position, the leading edge 106 of the cleaning plate 100 is substantially aligned with the leading edge 62 of the elevator plate 56 and the upper surface 102 of the cleaning plate 100 is substantially flush with the upper surface 60 of the elevator plate 56. Thus, the upper surface 102 of the cleaning plate 56 forms at least a portion of the surface that supports the media stack 32 for the elevator plate 56.

The elevating mechanism 58 lifts the elevator plate 56 until the media stack 32 is depleted at which point the upper surface 102 of the cleaning plate is exposed as depicted in FIGS. 3 and 4. The elevator plate is lifted until the cleaning plate 100 engages the nudger roll 38. The nudger roll drives the cleaning plate in the process direction P which causes the cleaning plate 100 to slide from the retracted position in the docking region 114 toward the extended position (FIGS. 5 and 6). The cleaning plate 100 and the elevator plate 56 include complementary guide features that cooperate to guide movement of the cleaning plate 100 with respect to the elevator plate 56. In one embodiment, the cleaning plate 100 is provided with guide rails 116 that are slidably received in complementary configured guide slots 118 in the elevator plate. The cleaning plate 100 and elevator plate 56, however, can be attached to each other in any suitable manner that enables movement between the retracted and extended positions.

In one embodiment, a pair of biasing members 120, shown as springs in the figures, is connected between the cleaning plate 100 and the elevator plate 56. The biasing members are configured to apply a biasing force that tends to move the cleaning plate in the reverse direction R toward the retracted position. The biasing force maintains the cleaning plate 100 in the retracted position until the cleaning plate 100 is contacted by the nudger roll 38. The nudger roll 38 generates sufficient force to overcome the biasing action of the members 120 to drive the cleaning plate in the process direction P so the cleaning plate 100 is moved from the retracted position to the extended position. While a pair of biasing members are shown in the figures, a single biasing member or more than two can be used to bias the cleaning plate 100 towards the retracted position.

In the extended position, the leading edge 106 of the cleaning plate 100 is located a predetermined distance D forward of the leading edge 62 of the elevator plate 56 in the process direction P. The cleaning plate 100 has a length between the leading edge 106 and the trailing edge 108 that enables the cleaning plate 100 to extend from the elevator plate 56 into the feed nip 46 when the cleaning plate 100 is in the extended position as depicted in FIGS. 5 and 6. With the cleaning plate 100 received in the feed nip, the nudger roll 38, feed roll 40, and retard roll 44 (if capable) are rotated against the cleaning plate 100 to clean the rolls of paper dust, debris, and other contaminants.

In one embodiment, the elevator plate 56 is configured to move vertically from a media empty position (e.g., FIG. 3) to a cleaning position (e.g., FIG. 5) before cleaning operations are performed. In this embodiment, when the elevator plate 56 is emptied of print media, the elevator plate 56 and cleaning plate 100 are spaced apart from the nudger roll 38. The controller 76 is configured to actuate the elevating mechanism 58 to move the elevator 56 from the media empty position to the cleaning position when the media sensor 70 detects that the elevator plate 56 is empty of media.

In one embodiment, the controller is configured to move only the elevator plate to the cleaning position at selected times or at selected intervals. For example, the controller can be configured to implement a process to determine whether a cleaning cycle needs to be performed once the media tray has been indicated as being empty. The process can take various predefined factors and criteria into consideration to determine appropriate times to perform a cleaning cycle. In one embodiment, the controller is configured to maintain a count of the number of sheets that have been fed through the nip 46 since the media feeder 30 has been cleaned and to activate a cleaning cycle (e.g., move the elevator plate to the cleaning position) when a predetermined count threshold value has been reached. After each cleaning cycle, the count value for the cleaning cycle is reset to zero.

As depicted in FIGS. 3 and 5, a latching mechanism 128 may be used to hold the cleaning plate 100 in the retracted position until the elevator plate 56 reaches the cleaning position. In one embodiment, the latching mechanism 128 comprises a post structure that extends from the bottom of the media tray 28. The post structure 128 is positioned in engagement with a portion of the cleaning plate 100, such as a detent 130, to block movement of the cleaning plate 100 from the retracted position while the elevator plate 56 is below the cleaning position (FIG. 3). When the elevator plate 56 reaches the cleaning position, the cleaning plate 100 is separated from the latching mechanism 128 and to enable the cleaning plate to travel to the extended position as depicted in FIG. 5.

Figure 7:
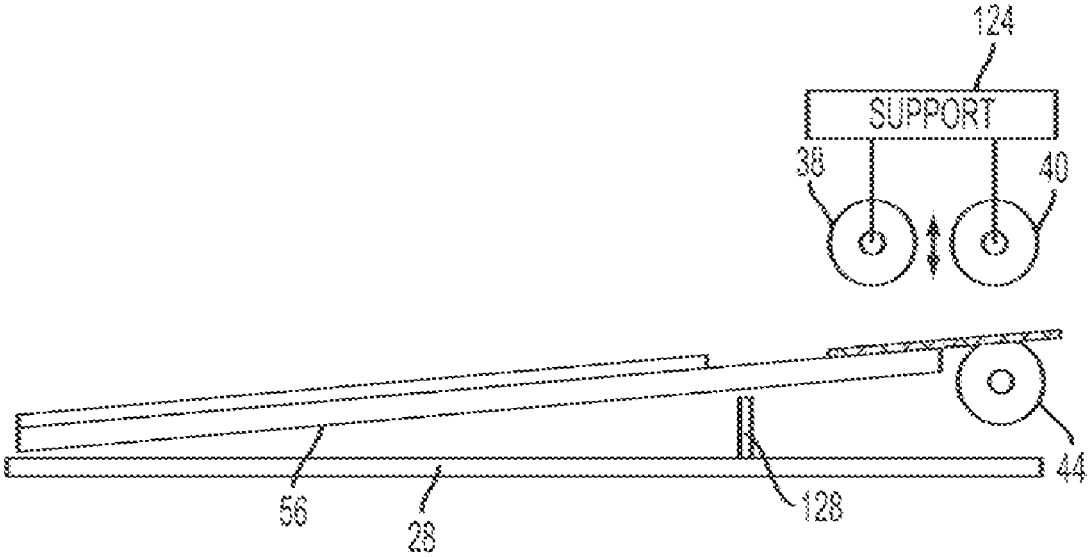
FIG. 7 is a side view of the media tray and media feeder of FIG. 2 with the cleaning plate in the extended position and with the rolls of the media feeder separated to allow retraction of the cleaning plate.

In one embodiment, the nudger roll, feed roll, and retard roll are connected to a positioning mechanism 124 (FIG. 7) that is configured to move the nudger roll 38 away from the cleaning plate 100 and move the feed roll 40 away from the retard roll 44 to separate the nip 46 so the cleaning plate 100 can be retracted into the docking region 114. Once the driving force of the nudger roll 38 and feed roll 40 are removed from the cleaning plate 100, the biasing member 120 is able to return the cleaning plate 100 to the retracted position (FIGS. 3 and 4). Any of a number of mechanisms and methods can be implemented to move the nudger roll away from the cleaning plate and separate the rolls of the feed nip.

The elevator positioning mechanism 58 is configured to maintain the elevator plate 56 in place while the cleaning plate 100 is extended. Once the cleaning plate 100 is returned to the retracted position, the elevator positioning mechanism 58 operates to enable the elevator plate 56 to drop to a loading position (FIG. 2) so media sheets can be loaded onto the elevator plate. The elevator positioning mechanism 58 may be configured to actively lower the elevator plate 56 to the loading position. Alternatively, the elevator positioning mechanism 58 may be configured to allow the elevator plate 56 to drop freely to the loading position.

In one embodiment, the mechanisms for retracting the nudger roll and separating the feed roll and retard roll as well as lowering the elevator plate are linked mechanically to the operation of the media tray 28 so that the cleaning plate 100 is retracted and the elevator plate 56 is lowered when the media tray 28 is accessed or opened by an operator. Alternatively, the mechanisms can be operated by the control system of the device and activated based on sensor input. For example, a media tray sensor (not shown) may be used to detect when the media tray is being opened so the cleaning plate can be retracted and the elevator plate dropped.

Figure 8:
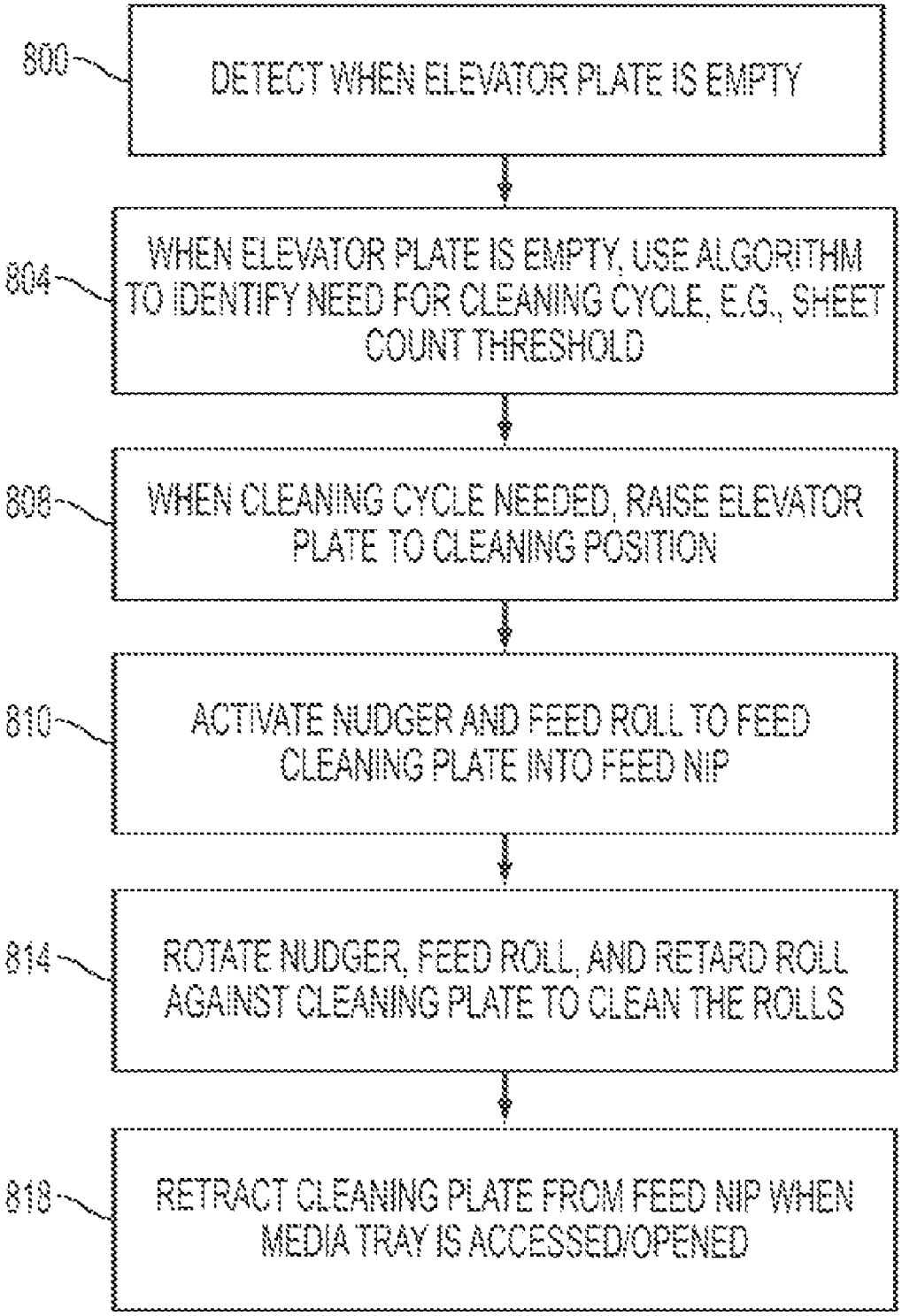
FIG. 8 is a flowchart of a method of operating the media tray and media feed system of FIG. 1.

A flowchart of a method of cleaning a media feeder of a printer is depicted in FIG. 8. The method begins determining whether media sensor indicated whether the media tray is empty of print media (block 800). The controller then implements a process to identify whether a cleaning cycle is to be performed (block 804). For example, the controller can compare the sheet count value to the threshold value for performing a cleaning cycle. If the controller determines a cleaning cycle is to be performed, the elevator plate is raised to the cleaning position (block 808). In the cleaning position, the cleaning plate attached to the elevator plate contacts the nudger roll. The nudger roll and feed roll are then rotated to drive the cleaning plate into the feed nip (block 810). The nudger roll and feed roll (and retard roll if capable) are then rotated against the cleaning plate to clean the rolls of dust and debris (block 814). The cleaning plate is retracted out of the feed nip and returned to the elevator plate when the media tray is accessed (block 818).

The feed roll cleaning mechanism integrated into the media tray as described above enables the media feeding system to be cleaned automatically with little to no downtime and without requiring operator intervention. This type of cleaning system can be incorporated into any media feeding system that utilizes an elevator plate and a nudger. In addition, the system is low cost because no additional drive systems or complicated mechanisms are required.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A media feeding apparatus for a printer, the apparatus comprising:

a first member configured to move print media in a process direction in a printer; and a media tray configured to retain a stack of print media, the media tray including:

a first plate having an upper surface upon which the stack of print media is placed, the first plate being movable between a first position to enable media to be loaded onto the upper surface of the first plate and a second position; and a second plate operatively connected to the first plate and selectively displaceable in the process direction with respect to the first plate when the first plate is at the second position to enable the second plate to move between a first position at which the second plate is out of contact with the first member and a second position at which the second plate contacts the first member.

2. The apparatus of claim 1 wherein the first plate moves in a direction that is vertical with respect to the process direction.

3. The apparatus of claim 1 further comprising:

a second member positioned to contact the second plate when the first plate is in the second position, and the second member being configured to move the second plate between the first position and the second position to selectively engage the first member with the second plate.

4. The apparatus of claim 3, the second member further comprising:

a roller; and an actuator operatively connected to the roller to rotate the roller and move the second plate between the first position and the second position.

5. The apparatus of claim 3, the first member further comprising:

a first roller;

a second roller positioned proximate the first roller to form a nip;

an actuator operatively connected to one of the first roller and the second roller, the actuator being configured to rotate the one roller operatively connected to the actuator; and a portion of the second plate entering the nip formed between the first roller and the second roller in response to the second member moving the second plate to the second position at which the second plate contacts the roller operatively connected to the actuator.

6. The apparatus of claim 5, the second member further comprising:

a third roller; and an actuator operatively connected to the third roller to rotate the third roller and move the second plate into and out of the nip between the first roller and the second roller.

7. The apparatus of claim 5 further comprising:

a sensor configured to detect an absence of print media resting on the first plate; and an actuator operatively connected to the first plate, the actuator being configured to move the first plate to the second position in response to the sensor detecting the absence of print media on the first plate.

8. The apparatus of claim 7 further comprising:

a biasing member configured to bias the second plate to the first position.

9. The apparatus of claim 1, the second plate further comprising:

a surface configured to remove debris from the first member.

10. A method of operating a media feeding apparatus for a printer comprises:

elevating a first plate of a media tray toward a first member of a media feeder, the first plate being configured to hold a stack of print media, the first member being configured to engage a top sheet of the stack and to move the top sheet in a process direction;

contacting a second plate with the first member when the first plate is empty of print media, the second plate being operatively connected to the first plate and selectively displaceable in the process direction with respect to the first plate; and actuating the first member to drive the second plate in the process direction from a first position out of contact with a second member of the media feeder to a second position where the second plate contacts the second member.

11. The method of claim 10 the contacting of the second plate with the first member further comprising:

engaging the second plate with a nudger roll; and the actuation of the first member further comprising:

actuating the nudger roll to drive the second plate into a nip formed between a first roller and a second roller.

12. The method of claim 11 further comprising:

actuating the nudger roll and the first roller with the second plate in the second position.

13. The method of claim 10, further comprising:

prior to contacting the second plate with the first member, elevating the first plate to a cleaning position when the first plate is empty of print media.

14. The method of claim 13, further comprising:

using a media sensor to detect when the first plate is empty of print media.

15. The method of claim 13, further comprising:

maintaining a count of a number of media sheets extracted from the stack by the media feeder;

comparing the count to a threshold count value; and elevating the first plate to the cleaning position in response to the media sensor indicating that the first plate is empty of print media and the count being greater than the threshold count value.

16. The method of claim 15, further comprising:

retracting the second plate from the second position to the first position in response to the media tray being accessed.

17. The method of claim 16, further comprising:

lowering the first plate to a loading position after the second plate is retracted from the second position to the first position.

* * * * *